US007398204B2

(12) United States Patent
Najaf-Zadeh et al.

(10) Patent No.: US 7,398,204 B2
(45) Date of Patent: Jul. 8, 2008

(54) BIT RATE REDUCTION IN AUDIO ENCODERS BY EXPLOITING INHARMONICITY EFFECTS AND AUDITORY TEMPORAL MASKING

(75) Inventors: Hossein Najaf-Zadeh, Nepean (CA); Hassan Lahdili, Hull (CA); Louis Thibault, Hull (CA); William Treurniet, Ajax (CA)

(73) Assignee: Her Majesty in Right of Canada as Represented by the Minister of Industry, Onawa, Ontario (CA)

( * ) Notice: Subject to any disclaimer, the term of this patent is extended or adjusted under 35 U.S.C. 154(b) by 808 days.

(21) Appl. No.: 10/647,320

(22) Filed: Aug. 26, 2003

(65) Prior Publication Data

US 2004/0044533 A1 Mar. 4, 2004

Related U.S. Application Data

(60) Provisional application No. 60/406,055, filed on Aug. 27, 2002.

(51) Int. Cl.
*G10L 11/04* (2006.01)
*G10L 21/00* (2006.01)

(52) U.S. Cl. ..... 704/207; 704/200.1

(58) Field of Classification Search ..... 704/200.1, 704/207, 201, 205, 206, 500; 700/94; 381/23, 381/98

See application file for complete search history.

(56) References Cited

U.S. PATENT DOCUMENTS 5,706,392 A 1/1998 Goldberg et al.

(Continued)

OTHER PUBLICATIONS

Huang et al., "A New Forward Masking Model and its Application to Perceptual Audio Coding", 1999 IEEE Int'l Conference on Acoustics, Speech, and Signal Processing, vol. 2, pp. 905-908, Pheonix, AZ, Mar. 15-19, 1999.

Usagawa et al., "Speech Parameter Extraction in Noisy Environment Using a Masking Model", Acoustics, Speech, and Signal Processing, 1994. ICASSP-94, 1999 IEEE Int'l Conference on Adelaide, SA, Australia, Apr. 19-22, 1994.

(Continued)

*Primary Examiner*—Vivian Chin
*Assistant Examiner*—Jason Kurr
(74) *Attorney, Agent, or Firm*—Breedman & Associates

(57) ABSTRACT

The present invention relates to a method for encoding an audio signal. In a first embodiment a model relating to temporal masking of sound provided to a human ear is provided. A temporal masking index is determined in dependence upon a received audio signal and the model using a forward and a backward masking function. Using a psychoacoustic model a masking threshold is determined in dependence upon the temporal masking index. Finally, the audio signal is encoded in dependence upon the masking threshold. The method has been implemented using the MPEG-1 psychoacoustic model 2. Semiformal listening test showed that using the method for encoding an audio signal according to the present invention the subjective high quality of the decoded compressed sounds has been maintained while the bit rate was reduced by approximately 10%. In a second embodiment, the inharmonic structure of audio signals is modeled and incorporated into the MPEG-1 psychoacoustic model 2. In the model, the relationship between the spectral components of the input audio signal is considered and an inharmonicity index is defined and incorporated into the MPEG-1 psychoacoustic model 2. Informal listening tests have shown that the bit rate required for transparent coding of inharmonic (multi-tonal) audio material can be reduced by 10% if the modified psychoacoustic model 2 is used in the MPEG 1 Layer II encoder.

12 Claims, 6 Drawing Sheets

U.S. PATENT DOCUMENTS 5,790,759 A * 8/1998 Chen ..... 704/200.1
6,064,954 A * 5/2000 Cohen et al. ..... 704/207
6,477,489 B1 * 11/2002 Lockwood et al. ..... 704/200.1
2004/0122662 A1 * 6/2004 Crockett ..... 704/200.1

* cited by examiner

BIT RATE REDUCTION IN AUDIO ENCODERS BY EXPLOITING INHARMONICITY EFFECTS AND AUDITORY TEMPORAL MASKING

This application claims the benefit of U.S. Provisional Application No. 60/406,055 filed Aug. 27, 2002.

FIELD OF THE INVENTION

The present invention relates generally to the field of perceptual audio coding and more particularly to a method for determining masking thresholds using a psychoacoustic model.

BACKGROUND OF THE INVENTION

In present state of the art audio coders, perceptual models based on characteristics of a human ear are typically employed to reduce the number of bits required to code a given input audio signal. The perceptual models are based on the fact that a considerable portion of an acoustic signal provided to the human ear is discarded—masked—due to the characteristics of the human hearing process. For example, if a loud sound is presented to the human ear along with a softer sound, the ear will likely hear only the louder sound. Whether the human ear will hear both, the loud and soft sound, depends on the frequency and intensity of each of the signals. As a result, audio coding techniques are able to effectively ignore the softer sound and not assign any bits to its transmission and reproduction under the assumption that a human listener is not capable of hearing the softer sound even if it is faithfully transmitted and reproduced. Therefore, psychoacoustic models for calculating a masking threshold play an essential role in state of the art audio coding. An audio component whose energy is less than the masking threshold is not perceptible and is, therefore, removed by the encoder. For the audible components, the masking threshold determines the acceptable level of quantization noise during the coding process.

However, it is a well-known fact that the psychoacoustic models for calculating a masking threshold in state of the art audio coders are based on simple models of the human auditory system resulting in unacceptable levels of quantization noise or reduced compression. Hence, it is desirable to improve the state of the art audio coding by employing better—more realistic—psychoacoustic models for calculating a masking threshold.

Furthermore, the MPEG-1 Layer 2 audio encoder is widely used in Digital Audio Broadcasting (DAB) and digital receivers based on this standard have been massively manufactured making it impossible to change the decoder in order to improve sound quality. Therefore, enhancing the psychoacoustic model is an option for improving sound quality without requiring a new standard.

SUMMARY OF THE INVENTION

It is, therefore, an object of the present invention to provide a method for encoding an audio signal employing an improved psychoacoustic model for calculating a masking threshold.

It is further an object of the present invention to provide an improved psychoacoustic model incorporating non-linear perception of natural characteristics of an audio signal by a human auditory system.

In accordance with a first aspect of the present invention there is provided, a method for encoding an audio signal comprising the steps of:

receiving the audio signal;

providing a model relating to temporal masking of sound provided to a human ear;

determining a temporal masking index in dependence upon the received audio signal and the model;

determining a masking threshold in dependence upon the temporal masking index using a psychoacoustic model; and, encoding the audio signal in dependence upon the masking threshold.

In accordance with a second aspect of the present invention there is provided, a method for encoding an audio signal comprising the steps of:

receiving the audio signal;

decomposing the audio signal using a plurality of bandpass auditory filters, each of the filters producing an output signal;

determining an envelope of each output signal using a Hilbert transform;

determining a pitch value of each envelope using autocorrelation;

determining an average pitch error for each pitch value by comparing the pitch value with the other pitch values;

calculating a pitch variance of the average pitch errors;

determining an inharmonicity index as a function of the pitch variance;

determining a masking threshold in dependence upon the inharmonicity index using a psychoacoustic model; and, encoding the audio signal in dependence upon the masking threshold.

In accordance with the present invention there is further provided, a method for encoding an audio signal comprising the steps of:

receiving the audio signal;

determining a non-linear masking index in dependence upon human perception of natural characteristics of the audio signal;

determining a masking threshold in dependence upon the non-linear masking index using a psychoacoustic model; and, encoding the audio signal in dependence upon the masking threshold.

In accordance with the present invention there is further provided, a method for encoding an audio signal comprising the steps of:

receiving the audio signal;

determining a masking index in dependence upon human perception of natural characteristics of the audio signal other than intensity or tonality such that a human perceptible sound quality of the audio signal is retained;

determining a masking threshold in dependence upon the masking index using a psychoacoustic model; and, encoding the audio signal in dependence upon the masking threshold.

In accordance with the present invention there is yet further provided, a method for encoding an audio signal comprising the steps of:

receiving the audio signal;

determining a masking index dependence upon human perception of natural characteristics of the audio signal by considering at least a wideband frequency spectrum of the audio signal;

determining a masking threshold in dependence upon the masking index using a psychoacoustic model; and, encoding the audio signal in dependence upon the masking threshold.

BRIEF DESCRIPTION OF THE DRAWINGS

Exemplary embodiments of the invention will now be described in conjunction with the drawings in which.

DETAILED DESCRIPTION OF THE INVENTION

Figure 1:
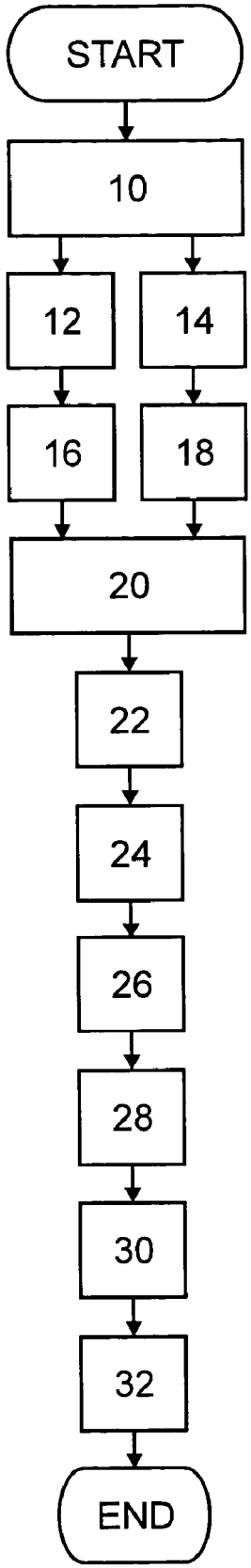
FIG. 1 is a simplified flow diagram of a first embodiment of a method for encoding an audio signal according to the present invention.

Most psychoacoustic models are based on the auditory "simultaneous masking" phenomenon where a louder sound renders a weaker sound occurring at a same time instance inaudible. Another less prominent masking effect is "temporal masking". Temporal masking occurs when a masker—louder sound—and a maskee—weaker sound—are presented to the hearing system at different time instances. Detailed information about the temporal masking is disclosed in the following references which are hereby incorporated by reference:

B. Moore, "An Introduction to the Psychology of Hearing", Academic Press, 1997;

E. Zwicker, and T. Zwicker, "Audio Engineering and Psychoacoustics, Matching Signals to the Final Receiver, the Human Auditory System", J. Audio Eng. Soc., Vol. 39, No. 3, pp 115-126, March 1991; and, E. Zwicker and H. Fastl, "Psychoacoustics Facts and Models", Springer Verlag, Berlin, 1990.

The temporal masking characteristic of the human hearing system is asymmetric, i.e. "backward masking" is effective approximately 5 msec before occurrence of a masker, whereas "forward masking" lasts up to 200 msec after the end of the masker. Different phenomena contributing to temporal auditory masking effects include temporal overlap of basilar membrane responses to different stimuli, short term neural fatigue at higher neural levels and persistence of the neural activity caused by a masker, disclosed in B. Moore, "An Introduction to the Psychology of Hearing", Academic Press, 1997; and A. Harma, "Psychoacoustic Temporal Masking Effects with Artificial and Real Signals", Hearing Seminar, Espoo, Finland, pp. 665-668, 1999, references which are hereby incorporated by reference.

Since psychoacoustic models are used for adaptive bit allocation, the accuracy of those models greatly affects the quality of encoded audio signals. Since digital receivers have been massively manufactured and are now readily available, it is not desirable to change the decoder requirements by introducing a new standard. However, enhancing the psychoacoustic model employed within the encoders allows for improved sound quality of an encoded audio signal without modifying the decoder hardware. Incorporating non-linear masking effects such as temporal masking and inharmonicity into the MPEG-1 psychoacoustic model 2 significantly reduces the bit rate for transparent coding or equivalently, improves the sound quality of an encoded audio signal at a same bit rate.

In a first embodiment of a method for encoding an audio signal according to the invention a temporal masking index is determined in a non-linear fashion in time domain and implemented into a psychoacoustic model for calculating a masking threshold. In particular, a combined masking threshold considering temporal and simultaneous masking is calculated using the MPEG-1 psychoacoustic model 2. Listening tests have been performed with MPEG-1 Layer 2 audio encoder using the combined masking threshold. In the following it will become apparent to those of skill in the art that the method for encoding an audio signal according to the invention has been implemented into the MPEG-1 psychoacoustic model 2 in order to use a standard state of the art implementation but is not limited thereto.

Since the temporal masking method according to the invention is implemented in the MPEG-1 Layer 2 encoder, the relation between some of the encoder parameters and the temporal masking method will be discussed in the following. In the MPEG-1 psychoacoustic model 32 Signal-to-Mask-Ratios (SMR) corresponding to 32 subbands are calculated for each block of 1152 input audio samples. Since the time-to-frequency mapping in the encoder is critically sampled, the filterbank produces a matrix—frame—of 1152 subband samples, i.e. 36 subband samples in each of the 32 subbands. Accordingly, the temporal masking method according to the invention as implemented in the MPEG-1 psychoacoustic model acquires 72 subband samples—36 samples belonging to a current frame and 36 samples belonging to a previous frame—in each subband and provides 32 temporal masking thresholds.

Referring to FIG. 1 a simplified flow diagram of the first embodiment of a method for encoding an audio signal is shown. The temporal masking method has been implemented using the following model suggested by W. Jesteadt, S. Bacon, and J. Lehman, "Forward masking as a function of frequency, masker level, and signal delay", J. Acoust. Soc. Am., Vol. 71, No. 4, pp. 950-962, April 1982, which is hereby incorporated by reference:

$$M=a(b-\log_{10}t)(L_m-c)$$

where M is the amount of masking in dB, t is the time distance between the masker and the maskee in msec, $L_m$ is the masker level in dB, and a, b, and c are parameters found from psychoacoustic data.

For determining the parameters in the above model the fact that forward temporal masking lasts for up to 200 msec whereas backward temporal masking decays in less than 5 msec has been considered. Furthermore, temporal masking at any time index is taken into account if the masker level is greater than 20 dB. Considering the above mentioned assumptions and based on listening tests of numerous audio materials the following forward and backward temporal masking functions have been determined, respectively. For forward masking $$FTM(j,i)=0.2(2.3-\log_{10}(\tau(j-i)))(L_f(i)-20),$$

where j=i+1, . . . , 36 is the subband sample index, τ is the time distance between successive subband samples—in msec, and $L_f(i)$ is the forward masker level in dB. For backward masking $$BTM(j,i)=0.2(0.7-\log_{10}(\tau(i-j)))(L_b(i)-20),$$

where j=1, . . . , i−1 is the subband sample index, τ is the time distance between successive subband samples—in msec, and $L_b(i)$ is the backward masker level in dB. For the backward temporal masking function the time axis is reversed.

The time distance τ between successive subband samples is a function of the sampling frequency. Since the filterbank in the MPEG audio encoder is critically sampled—box 10—one subband sample in each subband is produced for 32 input time samples. Therefore, the time distance τ between successive subband samples is $32/f_s$ msec, where $f_s$ is the sampling frequency in kHz.

The masker level in forward masking at time index i is given by $$L_f(i) = 10\ \log_{10}\frac{\sum_{k=-36}^{i} s^2(k)}{36+i},\ i = 1, \ldots, 35,$$

where s(k) denotes the subband sample at time index k—box 12. At any time index i the masker level is calculated as the average energy of the 36 subband samples in the corresponding subband in the previous frame and the subband samples in the current frame up to time index i.

Similarly, the masker level in backward masking—box 14—at time index i is given by $$L_b(i) = 10\ \log_{10}\frac{\sum_{k=i}^{36} s^2(k)}{36-(i-1)},\ i = 2, \ldots, 36.$$

The above equation gives the backward masker level at any time as the average energy of the current and future subband samples.

The forward temporal masking level at time index j is then calculated—box 16—as follows, $$M_f(j)=\max\{FTM(j,i)\}.$$

Similarly, the backward temporal masking level at time index j is then calculated—box 18—as, $$M_b(j)=\max\{BTM(j,i)\}.$$

The total temporal masking energy at time index j is the sum of the two components—box 20, $$E_T(j) = 10^{\frac{M_f(j)}{10}} + 10^{\frac{M_b(j)}{10}},$$

where $M_f$ and $M_b$ are the forward and the backward temporal masking level in dB at time index j, respectively.

The SMR at each subband sample is then calculated—box 22—as, $$SMR(j) = \frac{s^2(j)}{E_T(j)},\ j = 1, \ldots, 36,$$

where s(j) is the j-th subband sample.

Since in the MPEG audio encoder all the subband samples in each frame are quantized with the same number of bits, the maximum value of the 36 SMRs in each subband is taken to determine the required precision in the quantization process—box 24, $$SMR^{(n)}=\max\{SMR(j)\},\ n=1, \ldots, 32,$$

where $SMR^{(n)}$ is the required Signal-to-Mask-Ratio in subband n.

A combined masking threshold is then calculated considering the effect of both temporal and simultaneous masking. First the SMRs due to temporal masking are translated into allowable noise levels within a frequency domain. In order to achieve a same SMR in each subband in the frequency domain, the noise level in a corresponding subband in the frequency domain is calculated—box 26—as, $$N_{TM}^{(n)} = \frac{E_{sb}^{(n)}}{SMR^{(n)}},$$

where $N_{TM}^{(n)}$ is the allowable noise level due to temporal masking—temporal masking index—in subband n in the frequency domain, and $E_{sb}^{(n)}$ is the energy of the DFT components in subband n in the frequency domain. Alternatively, Parseval's theorem is used to calculate the equivalent noise level in the frequency domain.

In the following step, the noise levels due to temporal and simultaneous masking are combined—box 28. One possibility is to linearly sum the masking energies. However, according to psychoacoustic experiments the linear combination results in an under-estimation of the net masking threshold. Instead, a "power law" method is used for combining the noise levels, $$N_{net} = (N_{TM}^p + N_{SM}^p)^{1/p},$$

where $N_{TM}$ and $N_{SM}$ are the allowable noise due to temporal and simultaneous masking, respectively, and $N_{net}$ is the net masking energy. For the parameter p, a value of 0.4 has been found to provide an accurate combined masking threshold.

The net masking energy is used in the MPEG-1 psychoacoustic model 2 to calculate the corresponding SMR—masking threshold—in each subband—box 30, $$SMR_{net}^{(n)} = \frac{E_{sb}^{(n)}}{N_{net}^{(n)}}.$$

Finally, the acoustic signal is encoded using the masking threshold determined above—box 32.

Figure 2:
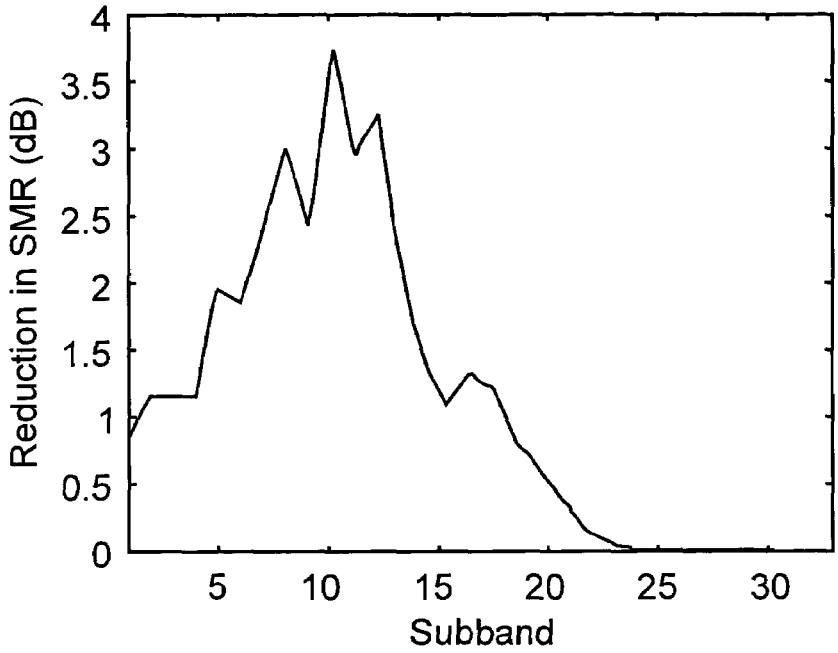
FIG. 2 is a diagram illustrating reduction in SMR due to temporal masking.

FIG. 2 shows an amount of reduction in SMR due to temporal masking in a frame of 1152 subband samples—36 samples in each of 32 subbands.

Numerous audio materials have been encoded and decoded with the MPEG-1 Layer 2 audio encoder using psychoacoustic model 2 based on simultaneous masking and the method for encoding an audio signal according to the invention based on the improved psychoacoustic model including temporal masking. Bit allocation has been varied adaptively to lower the quantization noise below the masking threshold in each frame. Use of the combined masking model resulted in a bit-rate reduction of 5-12%.

TABLE 1

| Audio Material | Average Bit Rate Without TM | Average Bit Rate With TM |
|---|---|---|
| Susan Vega | 153.8 | 138.1 |
| Tracy Chapman | 167.2 | 157.7 |
| Sax + Double Bass | 191.2 | 177.4 |
| Castanets | 150.2 | 132.0 |
| Male Speech | 120.1 | 112.4 |
| Electric Bass | 145.6 | 129.9 |

Table 1 shows the average bit rate for a few test files coded with a MPEG-1 Layer 2 encoder using the standard psychoacoustic model 2 and using the modified psychoacoustic model. The test files were 2-channel stereo audio signals sampled at 48 kHz with 16-bit resolution.

In order to compare the subjective quality of the compressed audio materials semiformal listening tests involving six subjects have been conducted. The listening tests showed that using the method for encoding an audio signal according to the invention the subjective high quality of the decoded compressed sounds has been maintained while the bit rate was reduced by approximately 10%.

Since psychoacoustic models are used for adaptive bit allocation, the accuracy of those models greatly affects the quality of encoded audio signals. For instance, the MPEG-1 Layer 2 audio encoder is used in Digital Audio Broadcasting (DAB) in Europe and in Canada. Since digital receivers have been massively manufactured and are now readily available, it is not possible to change the decoder without introducing a new standard. However, enhancing the psychoacoustic model allows improving the sound quality of an encoded audio signal without modifying the decoder. Incorporating temporal masking into the MPEG-1 psychoacoustic model 2 significantly reduces the bit rate for transparent coding or equivalently, improves the sound quality of an encoded audio signal at a same bit rate.

W. C. Treurniet, and D. R. Boucher have shown in "A masking level difference due to harmonicity", J. Acoust. Soc. Am., 109(1), pp. 306-320, 2001, which is hereby incorporated by reference, that the harmonic structure of a complex—multi-tonal—masker has an impact on the masking pattern. It has been found that if the partials in a multi-tonal signal are not harmonically related the resulting masking threshold increases by up to 10 dB. The amount of the increase depends on the frequency of the maskee and the frequency separation between the partials and the level of masker inharmonicity. For example, it has been found that for two different multi-tonal maskers having the same power, the one with a harmonic structure produces a lower masking threshold. This finding has been incorporated into a second embodiment of an audio encoder comprising a modified MPEG-1 psychoacoustic model 2.

A sound is harmonic if its energy is concentrated in equally spaced frequency bins, i.e. harmonic partials. The distance between successive harmonic partials is known as the fundamental frequency whose inverse is called pitch. Many natural sounds such as harpsichord or clarinet consist of partials that are harmonically related. Contrary to harmonic sounds, inharmonic signals consist of individual sinusoids, which are not equally separated in the frequency domain.

A model developed to measure inharmonicity recognizes that an auditory filter output envelope is modulated when the filter passes two or more sinusoids as shown in Appendix A. since a harmonic masker has constant frequency differences between its adjacent partials, most auditory filters will have the same dominant modulation rate. On the other hand, for an inharmonic masker, the envelope modulation rate varies across auditory filters because the frequency differences are not constant.

When the signal is a complex masker comprising a plurality of partials, interaction of neighboring partials causes local variations of the basilar membrane vibration pattern. The output signal from an auditory filter centered at the corresponding frequency has an amplitude modulation corresponding to that location. To a first approximation, the modulation rate of a given filter is the difference between the adjacent frequencies processed by that filter. Therefore, the dominant output modulation rate is constant across filters for a harmonic signal because this frequency difference is constant. However, for inharmonic maskers, the modulation rate varies across filters. Consequently, in the case of a harmonic masker the modulation rate for each filter output signal is the fundamental frequency. When inharmonicity is introduced by perturbing the frequencies of the partials, a variation of the modulation rate across filters is noticeable. The variation increases with increasing inharmonicity. In general, the harmonicity nature of a complex masker is characterized by the variance calculated from the envelope modulation rates across a plurality of auditory filters.

Figure 3A:
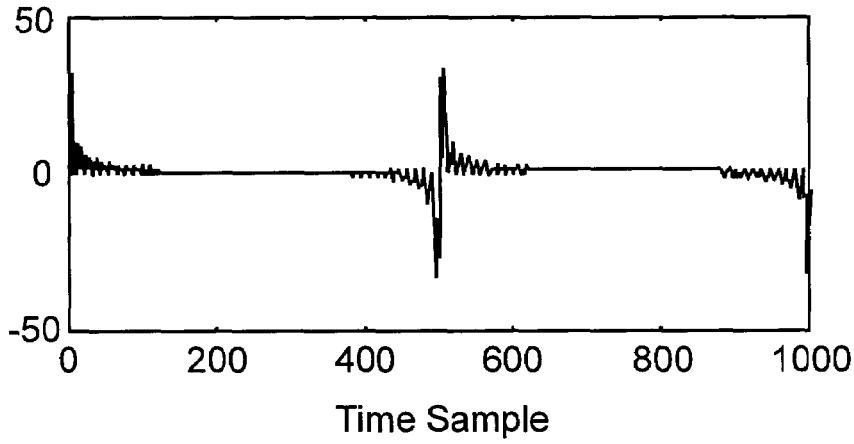
FIGS. 3*a* and 3*b* are diagrams illustrating an example of a harmonic and an inharmonic signal, respectively.
Figure 3B:
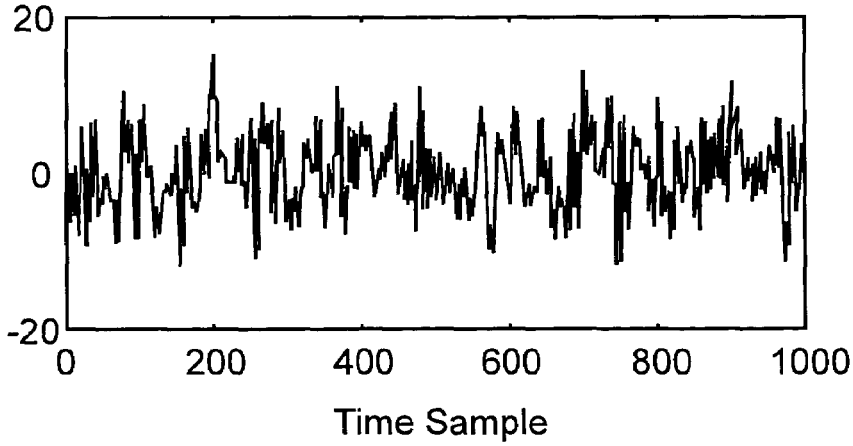

Since a harmonic signal is characterized by particular relationships among sharp peaks in the spectrum, an appropriate starting point for measuring the effect of harmonicity is a masker having a similar distribution of energy across filters, but with small perturbations in the relationships among the spectral peaks. FIG. 3*a* shows an example of a harmonic signal comprising a fundamental frequency of 88 Hz, and a total of 45 equally spaced partials covering a range from 88 Hz to 3960 Hz. FIG. 3*b* shows an inharmonic signal generated by slightly perturbing the frequencies and randomizing the phases of the harmonic signal partials.

Figure 4:
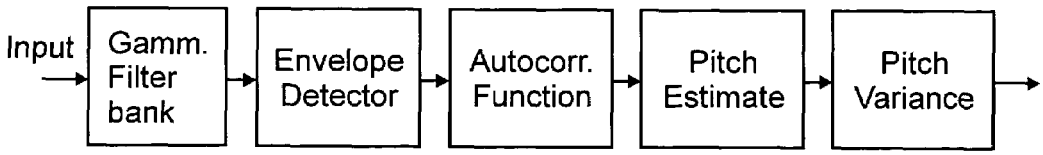
FIG. 4 is a simplified flow diagram illustrating a process for determining inharmonicity of an audio signal according to the invention.
Figure 5A:
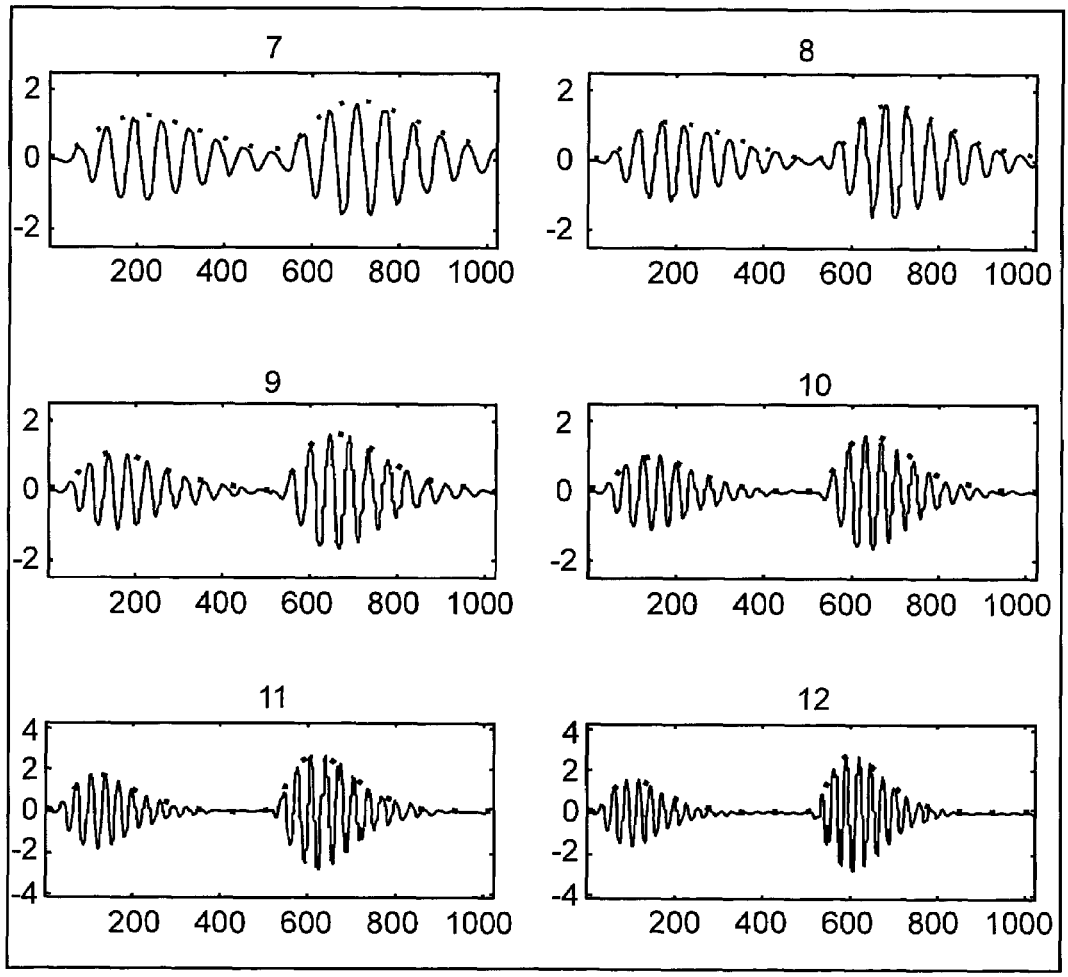
FIGS. 5*a* and 5*b* are diagrams illustrating the outputs of a gammatone filterbank for a harmonic and an inharmonic signal, respectively.
Figure 5B:
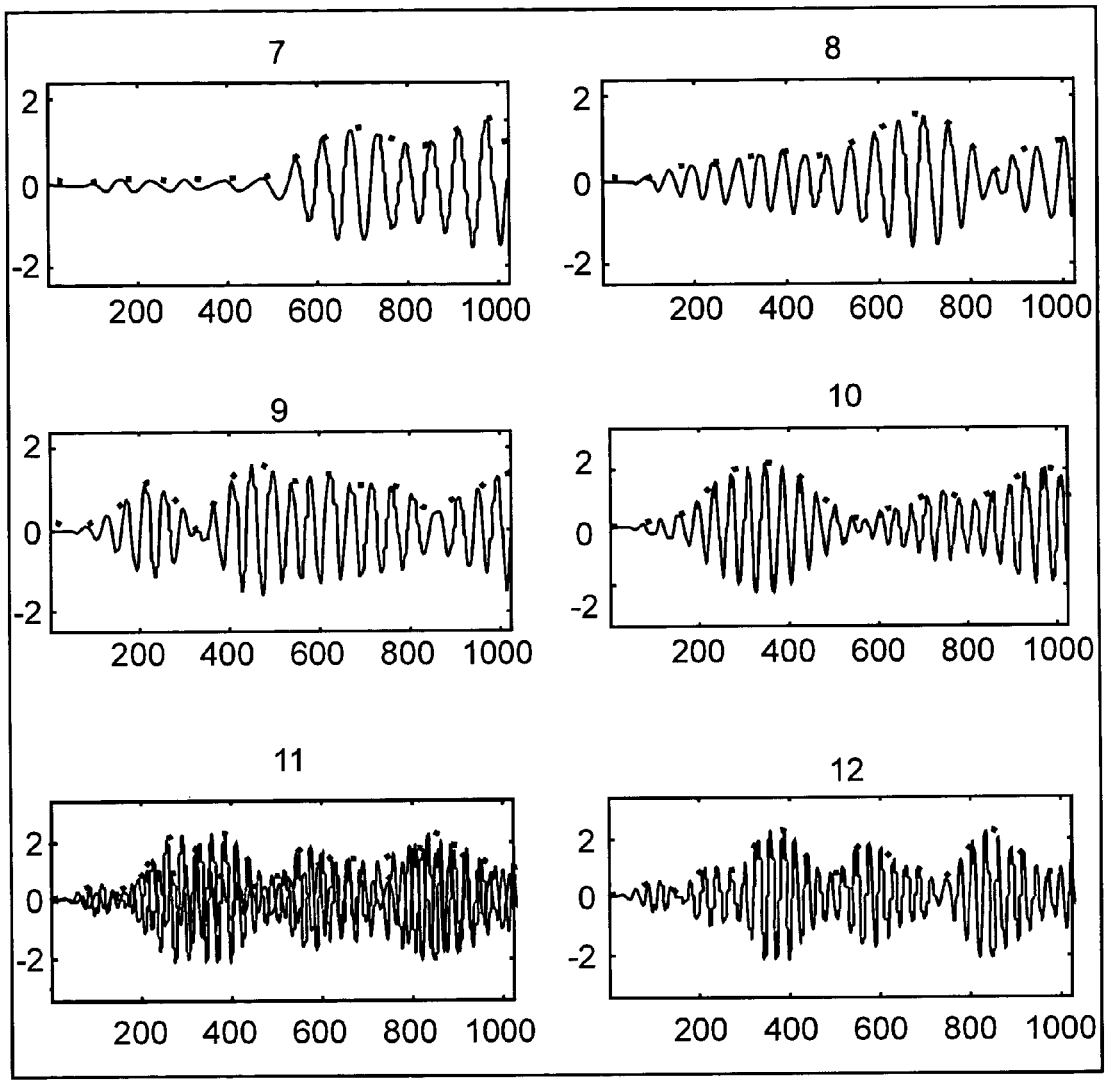
Figure 6A:
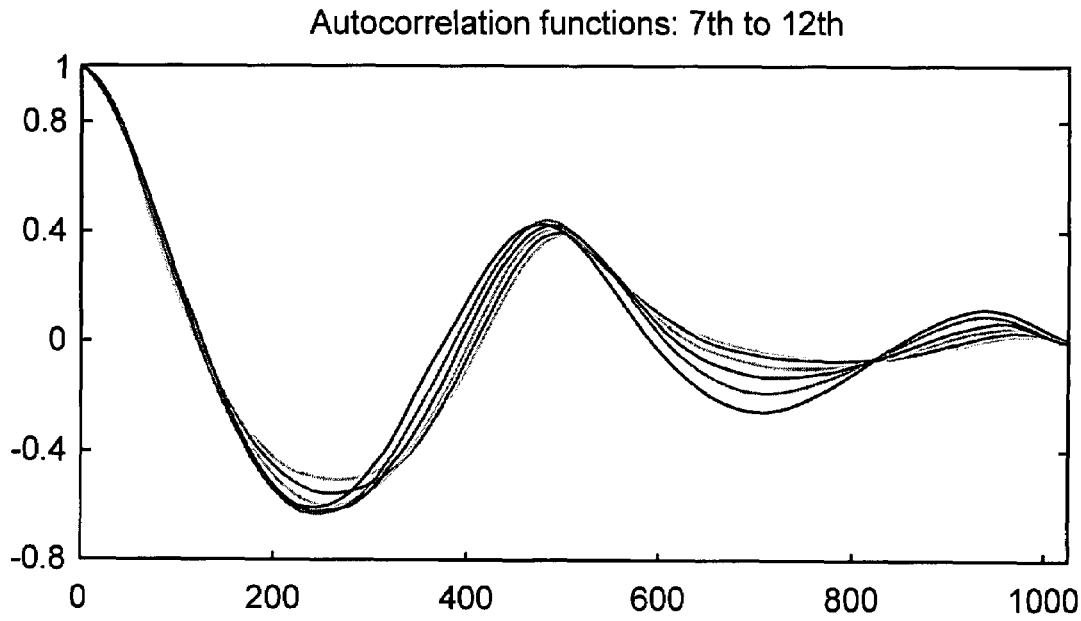
FIGS. 6*a* and 6*b* are diagrams illustrating the envelope autocorrelation for a harmonic and an inharmonic signal, respectively; and, FIG. 7 is a simplified flow diagram of a second embodiment of a method for encoding an audio signal according to the present invention.
Figure 6B:
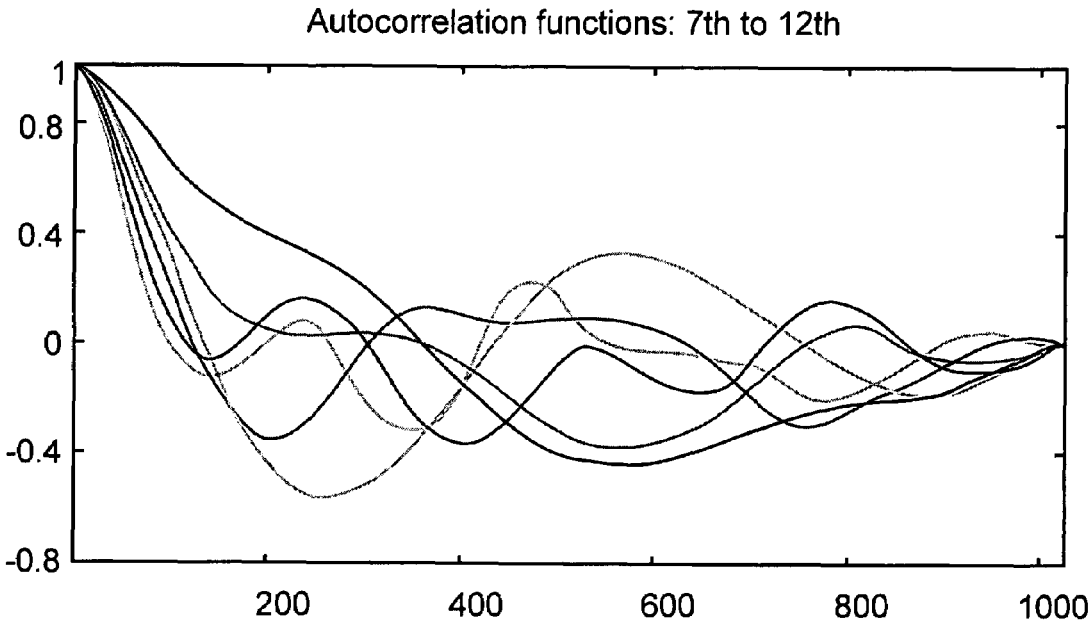

A process for estimating the harmonicity is illustrated in the flow chart of FIG. 4. The signal is analyzed using a "gammatone" filterbank based on the concept of critical bands disclosed in E. Zwicker, and E. Terhardt, "Analytical expressions for critical-band rate and critical bandwidth as a function of frequency", J. Acoust. Soc. Am., 68(5), pp. 1523-1525, 1980, which is hereby incorporated by reference. The output of each filter is processed with a Hilbert transform to extract the envelope. An autocorrelation is then applied to the envelope to estimate its period. Finally, the harmonicity measure is related to the variance of the modulation rates, i.e. envelope periods. This variance is negligible for a harmonic masker. However, for an inharmonic masker the variance is expected to be very large since the modulation rates vary across filters. For example, the two signals shown in FIGS. 3*a* and 3*b* have been analyzed to verify the process. FIGS. 5*a*, 5*b*, 6*a*, and 6*b* illustrate the output signals of the gammatone filterbank—channels 7-12 —and the corresponding autocorrelation functions for the harmonic—FIGS. 5*a* and 6*a*—and inharmonic inputs—FIGS. 5*b* and 6*b*. As shown in FIGS. 6*a* and 6*b*, there is a notable difference between the autocorrelation functions. In the case of the harmonic signal all the peaks related to the dominant modulation rate are coincident. Consequently, the variance of the modulation rates is negligible. On the other hand, for the inharmonic signal, the peaks are not coincident. Therefore, the variance is much larger. A harmonicity estimation model based on the variability of envelope modulation rates differentiates harmonic from inharmonic maskers. The variance of the modulation rate measures the degree to which an audio signal departs from harmonicity, i.e. a near zero value implies a harmonic signal while a large value—a few hundreds—corresponds to a noise-like signal.

In the MPEG-1 Layer 2 psychoacoustic model 2, in order to achieve transparent coding, the minimum SMRs are computed for 32 subbands as follows. A block of 1056 input samples is taken from the input signal. The first 1024 samples are windowed using a Hanning window and transformed into the frequency domain using a 1024-point FFT. The tonality of each spectral line is determined by predicting its magnitude and phase from the two corresponding values in the previous transforms. The difference of each DFT coefficient and its predicted value is used to calculate the unpredictability measure. The unpredictability measure is converted to the "tonality" factor using an empirical factor with a larger value indicating a tonal signal. The required SNR for transparent coding is computed from the tonality using the following empirical formula $$SNR_j = t_j TMN_j + (1-t_j) NMT_j,$$

where $t_j$ is the tonality factor, $TMN_j$ and $NMT_j$ are the value for tone-masking-noise and noise-masking-tone in subband j, respectively. $NMT_j$ is set to 5.5 dB and $TMN_j$ is given in a table provided in the MPEG audio standard. In order to take into account stereo unmasking effects $SNR_j$ is determined to be larger than the minimum SNR $minval_j$ given in the standard. The SMR is calculated for each of the 32 subbands from the corresponding SNR. The above process is repeated for the next block of 1056 time samples—480 old and 576 new samples—and another set of 32 SMR values is computed. The two sets of SMR values are compared and the larger value for each subband is taken as the required SMR.

Since the masking threshold due to a tonal and a noise-like signal is different, a tonality factor is calculated for each spectral line. The tonality factor is based on the unpredictability of the spectral components, meaning that higher unpredictability indicates a more noise-like signal. However, this measure does not distinguish between harmonic and inharmonic input signals as it is possible that they are equally predictable. In the second embodiment of a method for encoding an audio signal, the MPEG-1 psychoacoustic model 2 has been modified considering imperfect harmonic structures of complex tonal sounds. It will become apparent to those skilled in the art that the method considering imperfect harmonic structures is not limited to the implementation in the MPEG-1 psychoacoustic model 2 but is also implementable into other psychoacoustic models. The example shown hereinbelow has been chosen because the MPEG-1 Layer 2 encoding is a widely used state of the art standard encoding process. The inharmonicity of an audio signal raises the masking threshold and, therefore, incorporating this effect into the encoding process of inharmonic input signals substantially reduces the bit rate.

Figure 7:
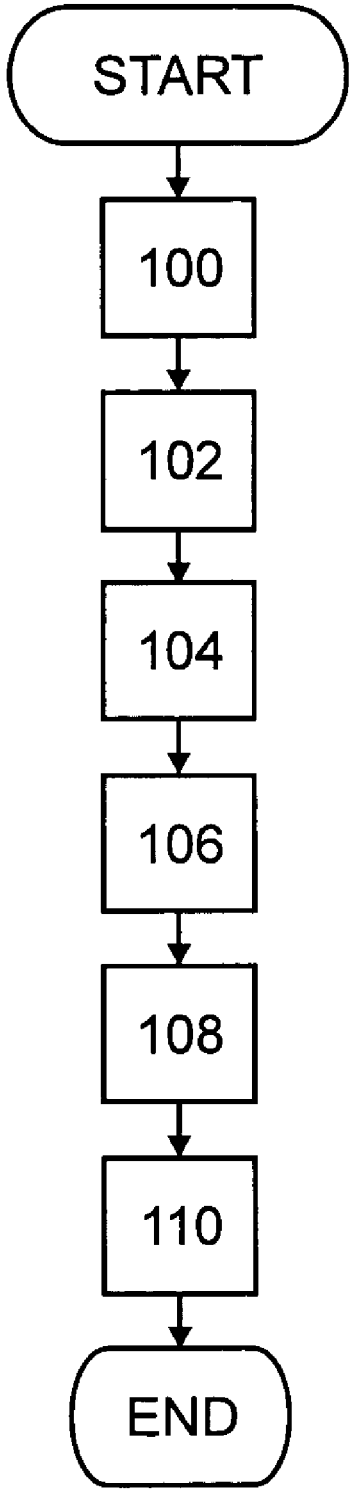

In the MPEG-1 psychoacoustic model 2 the TMN parameter is given in a table. The values for the TMNs are based on psychoacoustic experiments in which a pure tone is used to mask a narrowband noise. In these experiments the masker is periodic, which is the case with an inharmonic masker. In fact, a noise probe is detected at a lower level when the masker is harmonic. This is likely caused by a disruption of the pitch sensation due to the periodic structure of the masker's temporal envelope, as taught in W. C. Treurniet, and D. R. Boucher, "A masking level difference due to harmonicity", J. Acoust. Soc. Am., 109(1), pp. 306-320, 2001, which is hereby incorporated by reference. In the second embodiment of a method for encoding an audio signal, the TMN parameter is modified in dependence upon the input signal inharmonicity, as shown in the flow diagram of FIG. 7. Since in the MPEG-1 Layer 2 psychoacoustic model 2 a set of 32 SMRs is calculated for each 1152 time samples, the same time samples are analyzed for measuring the level of input signal inharmonicity. After determining the input signal inharmonicity, an inharmonicity index is calculated and subtracted from the TMN values. The inharmonicity index as a function of the periodic structure of the input signal is calculated as follows. The input block of 1632 time samples is decomposed using a gammatone filterbank—box 100. The envelope of each bandpass auditory filter output is detected using the Hilbert transform—box 102. The pitch of each envelope is calculated based on the autocorrelation of the envelope—box 104. Each pitch value is then compared with the other pitch values and an average error is determined—box 106. Then, the variance of the average errors is calculated—box 108. According to W. C. Treurniet, and D. R. Boucher inharmonicity causes an increase of up to 10 dB in the masking threshold. Therefore, the inharmonicity index $\delta_{ih}$ as a function of the pitch variance $V_p$ has been defined by the inventors to cover a range of 10 dB—box 106, $$\delta_{ih} = 3 \log_{10}(V_p + 1).$$

The above equation produces a zero value for a perfect harmonic signal and up to 10 dB for noise-like input signals. The new inharmonicity index is incorporated—box 108—into the MPEG-1 psychoacoustic model 2 for calculating the masking threshold as $$SNR_j = \max\{\min val_j t_j (TMN_j - \delta_{ih}) + (1-t_j) NMT_j\}.$$

Finally, the acoustic signal is encoded using the masking threshold determined above—box 110.

As shown above, the level of inharmonicity is defined as the variance of the periods of the envelopes of auditory filters outputs. The period of each envelope is found using the autocorrelation function. The location of the second peak of the autocorrelation function—ignoring the largest peak at the origin—determines the period. Since the autocorrelation function of a periodic signal has a plurality of peaks, the second largest peak sometimes does not correspond to the correct period. In order to overcome this problem in calculating the difference between two periods the smaller period is compared to a submultiple of the larger period if the difference becomes smaller. A MATLAB script for calculating the pitch variance is presented in Appendix B. Another problem occurs when there is no peak in the autocorrelation function. This situation implies an aperiodic envelope. In this case the period is set to an arbitrary or random value.

As shown in Appendix A, if at least two harmonics pass through an auditory filter the envelope of the output signal is periodic. Therefore, in order to correctly analyze an audio signal the lowest frequency of the gammatone filterbank is chosen such that the auditory filter centered at this frequency passes at least two harmonics. Therefore, the corresponding critical bandwidth centered at this frequency is chosen to be greater than twice the fundamental frequency of the input signal. The fundamental frequency is determined by analyzing the input signal either in the time domain or the frequency domain. However, in order to avoid extra computation for determining the fundamental frequency the median of the calculated pitch values is assumed to be the period of the input signal. The fundamental frequency of the input signal is then simply the inverse of the pitch value. Therefore, the lower bound for the analysis frequency range is set to twice the inverse of the pitch value.

In order to compare the subjective quality of the compressed audio materials informal listening tests have been conducted. Several audio files have been encoded and decoded using the standard MPEG-1 psychoacoustic model 2 and the modified version according to the invention. The bit allocation has been varied adaptively on a frame by frame basis. When the inharmonicity model was included the bit rate was reduced without adverse effects on the sound quality. The informal listening tests have shown that for multi-tonal audio-material the required bit rate decreases by approximately 10%.

As disclosed above a single value has been used to adjust the masking threshold for the entire frequency range of the input signal based on the complete frequency spectrum of the input signal. Alternatively, the masking threshold is modified based on the local harmonic structure of the input signal based on a local wideband frequency spectrum of the input signal.

Optionally, a combination of both non-linear masking effects indicated by the temporal masking index and the inharmonicity index are implemented into the MPEG-1 psychoacoustic model 2.

Of course, numerous other embodiments of the invention will be apparent to persons skilled in the art without departing from the spirit and scope of the invention as defined in the appended claims.

Appendix A

In the following it is shown that the envelope of the following signal is periodic with a period of either multiple or submultiple of $P_0$, i.e. the inverse of the fundamental frequency $f_0$.

$$y(t)=a_m\cos(m\omega_0 t+\phi_m)+a_n\cos(n\omega_0 t+\phi_n) \tag{A1}$$

Rewriting equation (A1) yields $$y(t)=a_m\cos(m\omega_0 t+\phi_m)+a_m\cos(n\omega_0 t+\phi_n)+(a_n-a_m)\cos(n\omega_0 t+\phi_n) \tag{A2}$$

$$y(t)=2a_m\cos\left(\frac{(m-n)\omega_0 t+\phi_m-\phi_n}{2}\right)\times\cos\left(\frac{(m+n)\omega_0 t+\phi_m+\phi_n}{2}\right)+(a_n-a_m)\cos(n\omega_0 t+\phi_n) \tag{A3}$$

If (m+n) is much greater than (m−n), the first term in the above equation (A3) implies amplitude modulation. The low-pass signal is then expressed as $$\xi(t)=a\cos\left(\frac{(m-n)\omega_0 t+\phi_m-\phi_n}{2}\right) \tag{A4}$$

The period of the envelope ξ(t) is $$\frac{2P_0}{(m-n)}$$

which is a (sub)multiple of $P_0$. The second term in equation (A3) has no effect on the envelope due to being filtered out by the demodulator.

Appendix B

The pitch variance is calculated using the following MATLAB routine:

```
for i = 1 : N
  s = 0;
  for j = 1 : N
    if (j ~= i)
      pmax = max ( P (i), P (j) );
      pmin = min ( P (i), P (j) );
      a = round ( pmax / pmin );
      s = s + abs ( pmin − pmax / a);
    end
  end
  d (i) = s / (N − 1);
end
Vp = var (d)
```

In this routine, N is the number of auditory filters and P (.) is the pitch value.

What is claimed is:

1. A method for encoding an audio signal comprising:

receiving the audio signal;

decomposing the audio signal using a plurality of bandpass auditory filters, each of the filters producing an output signal;

determining an envelope of each output signal using a Hilbert transform;

determining a pitch value of each envelope using autocorrelation;

determining an average pitch error for each pitch value by comparing the pitch value with the other pitch values;

calculating a pitch variance of the average pitch errors;

determining an inharmonicity index as a function of the pitch variance;

determining a masking threshold in dependence upon the inharmonicity index using a psychoacoustic model; and, encoding the audio signal in dependence upon the masking threshold.

2. A method for encoding an audio signal as defined in claim 1 wherein the inharmonicity index covers a range of 10 dB.

3. A method for encoding an audio signal as defined in claim 2 wherein the inharmonicity index for a perfect harmonic signal has a zero value.

4. A method for encoding an audio signal as defined in claim 1 wherein the plurality of bandpass auditory filters comprises a gammatone filterbank.

5. A method for encoding an audio signal as defined in claim 4 wherein a lowest frequency of the gammatone filterbank is chosen such that the auditory filter centered at the lowest frequency passes at least two harmonics.

6. A method for encoding an audio signal as defined in claim 5 wherein the lowest frequency is set to twice the inverse of the median of the pitch values.

7. A method for encoding an audio signal as defined in claim 5 wherein the psychoacoustic model is a MPEG psychoacoustic model.

8. A method for encoding an audio signal as defined in claim 7 wherein a Tone-Masking-Noise Parameter of the MPEG-1 psychoacoustic model 2 is modified using the inharmonicity index.

9. A method comprising:

receiving an audio signal;

decomposing the audio signal using a plurality of bandpass auditory filters, each of the filters producing an output signal;

determining an envelope of each output signal using a Hilbert transform;

determining a pitch value of each envelope using autocorrelation;

determining an average pitch error for each pitch value by comparing the pitch value with the other pitch values;

calculating a pitch variance of the average pitch errors;

determining the inharmonicity index as a function of the pitch variance;

using the inharmonicity index adjusting a psychoacoustic model;

determining a masking threshold using the adjusted psychoacoustic model; and, providing the masking threshold.

10. A method as defined in claim 9 comprising:

processing the audio signal in dependence upon the masking threshold.

11. A method as defined in claim 9 wherein the psychoacoustic model is a MPEG psychoacoustic model.

12. A method as defined in claim 11 wherein a Tone-Masking-Noise Parameter of the MPEG-1 psychoacoustic model 2 is modified using the inharmonicity index.

* * * * *